US011566579B2

(12) United States Patent
Blake

(10) Patent No.: US 11,566,579 B2
(45) Date of Patent: Jan. 31, 2023

(54) METHOD AND SYSTEM FOR CONTROLLING AN ENGINE

(71) Applicant: Polaris Industries Inc., Medina, MN (US)

(72) Inventor: Dallas J. Blake, Roseau, MN (US)

(73) Assignee: Polaris Industries Inc., Medina, MN (US)

( * ) Notice: Subject to any disclaimer, the term of this patent is extended or adjusted under 35 U.S.C. 154(b) by 152 days.

(21) Appl. No.: 17/063,337

(22) Filed: Oct. 5, 2020

(65) Prior Publication Data

US 2021/0017931 A1 Jan. 21, 2021

Related U.S. Application Data

(62) Division of application No. 15/723,880, filed on Oct. 3, 2017.

(51) Int. Cl.

*F02D 41/06* (2006.01)
*F02D 41/24* (2006.01)
*F02D 41/40* (2006.01)

(52) U.S. Cl.

CPC ..... *F02D 41/40* (2013.01); *F02D 41/062* (2013.01); *F02D 41/2422* (2013.01); *F02D 2200/0602* (2013.01); *F02D 2200/0606* (2013.01); *F02D 2200/101* (2013.01); *F02D 2200/602* (2013.01); *F02D 2200/703* (2013.01); *F02D 2400/04* (2013.01)

(58) Field of Classification Search

CPC .... F02D 41/40; F02D 41/062; F02D 41/2422; F02D 2200/0602; F02D 2400/04; F02D 41/06; F02D 41/061; F02D 41/064; F02D 41/065; F02D 2200/0604; F02D 2200/703; F02D 2200/704

USPC ..... 123/465, 491

See application file for complete search history.

(56) References Cited

U.S. PATENT DOCUMENTS 4,015,568 A 4/1977 Horiye et al.
4,086,890 A * 5/1978 Minami ..... F02M 7/24 123/699
4,121,542 A 10/1978 Frie et al.
4,212,065 A * 7/1980 Marchak ..... F02D 41/30 123/480
4,213,181 A * 7/1980 Carp ..... F02D 41/266 700/282

(Continued)

*Primary Examiner* — Erick R Solis

(74) *Attorney, Agent, or Firm* — Harness, Dickey & Pierce, P.L.C.

(57) ABSTRACT

A system and method for operating an engine comprises an engine speed sensor generating an engine speed signal, a throttle position sensor generating a throttle position signal, a sensor module comprising at least one of a fuel pressure sensor generating a fuel pressure signal corresponding to a fuel pressure and a fuel temperature sensor generating a fuel temperature signal corresponding to a fuel temperature into the engine. A controller is coupled to the fuel injector, the engine speed sensor and the sensor module. The controller determines a pulse width duration for the fuel injector based on engine speed and throttle position, determining a pulse width correction factor as a function of at least one of the fuel temperature signal and the fuel pressure signal, determining a second pulse width duration based on the first pulse width, and operating the fuel injector with the second pulse width duration.

11 Claims, 11 Drawing Sheets

(56) References Cited

U.S. PATENT DOCUMENTS 4,275,694 A 6/1981 Nagaishi
4,286,552 A 9/1981 Tsutsumi
4,355,616 A 10/1982 Tamura et al.
4,368,705 A * 1/1983 Stevenson ..... F02D 41/401 123/357
4,376,431 A * 3/1983 Yokooku ..... F02D 41/0002 123/681
4,442,820 A 4/1984 Ina et al.
4,479,186 A 10/1984 Takao et al.
4,495,921 A * 1/1985 Sawamoto ..... F02M 3/09 123/480
4,512,315 A 4/1985 Tomisawa
4,522,177 A 6/1985 Kawai et al.
4,528,961 A 7/1985 Katoh et al.
4,681,076 A 7/1987 Muller
4,696,275 A * 9/1987 Kushi ..... F02D 41/32 123/480
4,699,109 A 10/1987 Hensel
4,788,960 A 12/1988 Oshizawa
4,864,998 A * 9/1989 Onishi ..... F02D 41/249 123/674
4,951,647 A * 8/1990 Ezumi ..... F02D 41/28 123/480
4,971,011 A 11/1990 Nanyoshi et al.
4,982,331 A 1/1991 Miyazaki
4,999,781 A 3/1991 Holl et al.
5,226,393 A * 7/1993 Nagano ..... F02D 41/04 123/478
5,237,975 A 8/1993 Betki et al.
5,355,859 A 10/1994 Weber
5,379,741 A 1/1995 Matysiewicz et al.
5,448,977 A 9/1995 Smith et al.
5,579,738 A * 12/1996 Frischmuth ..... F02D 41/3082 123/497
5,615,657 A 4/1997 Yoshizawa
5,632,248 A * 5/1997 Sugii ..... F02M 17/04 123/438
5,647,324 A 7/1997 Nakajima
5,806,497 A 9/1998 Hosoya
5,848,583 A 12/1998 Smith et al.
5,850,458 A 12/1998 Tomisawa et al.
5,865,158 A 2/1999 Cleveland et al.
5,970,955 A * 10/1999 Nakada ..... F02M 63/0225 123/305
5,992,373 A 11/1999 Hosoya et al.
6,047,682 A 4/2000 Fujino et al.
6,109,244 A 8/2000 Yamamoto et al.
6,138,642 A 10/2000 Zhang et al.
6,142,121 A * 11/2000 Nishimura ..... F02M 63/0225 123/456
6,223,731 B1 5/2001 Yoshiume et al.
6,286,480 B1 * 9/2001 Chen ..... F02D 41/401 123/380
6,520,167 B1 2/2003 Kanno
7,040,287 B2 * 5/2006 Steffen ..... F02M 17/04 123/438
7,082,928 B2 8/2006 Fritsch et al.
7,152,575 B2 12/2006 Fritsch et al.
7,263,426 B2 * 8/2007 Withrow ..... F02D 41/182 701/115
7,873,461 B2 1/2011 McDonald et al.
8,365,585 B2 2/2013 Barra et al.
8,374,770 B2 2/2013 Jung et al.
9,127,612 B2 9/2015 Nakata et al.
9,309,852 B2 4/2016 Joos et al.
2001/0003975 A1 * 6/2001 Nakamura ..... F02D 41/3836 123/464
2001/0023683 A1 9/2001 Nakamura et al.
2002/0038647 A1 4/2002 Tashiro et al.
2003/0037771 A1 * 2/2003 Yuya ..... F02D 41/047 123/491
2004/0002808 A1 1/2004 Hashimoto et al.
2004/0118385 A1 * 6/2004 Katoh ..... F02D 41/064 123/492
2005/0005900 A1 * 1/2005 Iriya ..... F02D 41/3076 123/295
2006/0021595 A1 2/2006 Miyashita
2006/0060162 A1 * 3/2006 Fukui ..... F02D 41/3094 123/179.16
2006/0225695 A1 * 10/2006 Fukasawa ..... F02D 41/062 123/305
2006/0266327 A1 * 11/2006 Fukasawa ..... F02D 41/3845 123/305
2007/0277786 A1 12/2007 Barnes et al.
2008/0183366 A1 7/2008 Bauerle
2012/0022740 A1 * 1/2012 Ohsaki ..... F02D 41/1446 701/33.9
2012/0203444 A1 * 8/2012 Niioka ..... F02D 41/0087 701/104
2013/0151052 A1 * 6/2013 Fukuzawa ..... F02D 37/02 701/22
2014/0007847 A1 1/2014 Joos et al.
2014/0299103 A1 * 10/2014 Yanoto ..... F02D 41/064 123/447
2016/0215725 A1 * 7/2016 Terauchi ..... F02D 41/182
2017/0030287 A1 * 2/2017 Matsunaga ..... F02D 41/3845
2018/0087464 A1 * 3/2018 Sekita ..... F02N 11/0862
2018/0328304 A1 * 11/2018 Pursifull ..... F02D 41/3854
2019/0101077 A1 * 4/2019 Blake ..... F02D 41/40

* cited by examiner

FUEL PRESSURE

| WATER TEMPERATURE | 0.5 | 1 | 1.5 | 2 | 2.5 | 3 | 3.5 | 4 |
|---|---|---|---|---|---|---|---|---|
| -40 | 165 | 150 | 130 | 116 | 110 | 106 | 106 | 106 |
| -30 | 135 | 125 | 110 | 110 | 103 | 98 | 95 | 95 |
| -20 | 130 | 120 | 95 | 90 | 88 | 82 | 65 | 60 |
| -10 | 90 | 85 | 85 | 80 | 75 | 70 | 50 | 45 |
| 0 | 75 | 70 | 70 | 70 | 70 | 60 | 42 | 38 |
| 20 | 48 | 45 | 45 | 40 | 35 | 30 | 25 | 22 |
| 40 | 9 | 9 | 9 | 5.6 | 3.5 | 2.4 | 1.4 | 1.2 |
| 50 | 5 | 5 | 4.3 | 4 | 3 | 1.5 | 1.2 | 1.1 |
| 70 | 3.5 | 3.5 | 2.1 | 2 | 1.6 | 1.4 | 1.2 | 1.1 |
| 80 | 3 | 3 | 2 | 1.4 | 1.3 | 1.2 | 1.2 | 1.1 |

REPLACEMENT OF LOOKUP VARIABLE WITH FUEL PRESSURE

FIG 6A

METHOD AND SYSTEM FOR CONTROLLING AN ENGINE

CROSS-REFERENCE TO RELATED APPLICATION

This application is a divisional of U.S. patent application Ser. No. 15/723,880 filed on Oct. 3, 2017. The entire disclosure of the above application is incorporated herein by reference.

FIELD

The present disclosure relates to engine control, and more specifically for determining pulse width durations for the fuel injectors.

BACKGROUND

This section provides background information related to the present disclosure which is not necessarily prior art.

Two-stroke snowmobile engines are highly tuned, high output and high specific power output engines that operate under a wide variety of conditions. The modern two-stroke snowmobile engines operate in ambient air temperatures of −40 to 100 degrees F. and from sea level to 12000 ft in elevation. Environmental factors combined with the significant impact of both engine speed and exhaust gas temperature on engine volumetric efficiency dictate that the fueling demands for a given snowmobile engine can vary significantly. This, in turn, puts high demands on the fuel system requirements to achieve acceptable combustion stability, power, and idle quality and low speed drivability.

Air density is one factor in two-stroke engine air consumption, and by extension fuel consumption, requirements. Gas law scaling of mass air flow due to environmental operating conditions, in a practical aspect, is a coupled phenomenon whereas vehicles operating at lower barometric pressure tend to also operate at higher ambient temperatures. Additionally, since the heat saturation of the intake tract is affected by the engine air mass flow and vehicle speed, the density scaling due to environmental conditions is further coupled to the vehicle operational conditions.

Practical applications and calibration requirements for 2-stroke engines trend towards a non-linear decrease in fueling with both an increase in elevation and a decrease in temperature. Deviation from the ideal gas law correlation is due to non-isentropic heating of the air mass passing through the engine and variations in air mass transfer latency through the engine due to an inherently unsteady and non-fully developed flow within the entirety of the gas path of the engine. Overall correction to fueling required with coupled temperature and barometric pressure effects can total as much as 20% within the known operating condition window for a modern snowmobile.

Combined with the variations in air density are the variations that engine speed and exhaust gas temperature have on the semi-coupled mechanisms of exhaust gas scavenging and trapping and therefore, the whole engine volumetric efficiency. Due to the sensitive nature of the exhaust system frequency response, trapping and scavenging capacity on a high specific power output two-stroke engine, whole engine volumetric efficiency can vary by a factor of 1.5 at rated speed. This mechanism requires some degree of correction to either the airflow prediction or fuel control demand on some known parameter of the exhaust system acceptable as an indicator of volumetric efficiency.

Additionally, on a high performance two-stroke engine, due to both the desire for low idle speed with minimal smoke and high engine speed power output, the change in fueling requirements from idle to peak torque and peak power situations can exceed 70:1. This indicates the injector must have a dynamic range of 35:1.

Common injectors for low pressure, low voltage applications have a dynamic range of 20:1. This then requires a compromise to be made in the calibration of two-stroke engines to work in a wide range of environmental conditions. Often, a compromise must be made at low elevation so that when the barometric and temperature impacts on the fueling are considered, that the operation in the aforementioned scenario is not compromised. This, by nature dictates that the high elevation, warm temperature calibration is the baseline minimal fueling setting while the lower elevation, colder temperature situations may be richer than required to make the engine and vehicle acceptable at the lower fueling requirement.

Furthermore, with a batteryless fuel injection system, the first injection when the engine control unit (ECU) microprocessor is woken up is of critical importance for the starting performance and, by extension, the customer perception of quality. As the ECU voltage and chassis voltage are rising, the fuel pump is turned on. The fuel first injection duration under starting conditions has traditionally had very high durations within the fuel injection timing table to compensate for the lower fuel pressure under a starting event.

SUMMARY

This section provides a general summary of the disclosure, and is not a comprehensive disclosure of its full scope or all of its features.

The present disclosure provides an improved method for operating an engine, particularly a two-stroke engine for a snowmobile.

In one aspect of the disclosure, a system of operating the same includes a fuel injector, a fuel pressure sensor generating a fuel pressure signal, and a controller coupled to the fuel pressure sensor and the fuel injector. The controller prevents a fuel injector from injecting fuel into the engine when the fuel pressure is below a fuel pressure threshold. The controller injects fuel into the engine when the fuel pressure is above the fuel pressure threshold.

In another aspect of the disclosure, a method of initiating starting of a two-stroke engine, determining fuel pressure, when the fuel pressure is below a fuel pressure threshold, preventing a fuel injector from injecting fuel into the engine, and when the fuel pressure is above the fuel pressure threshold, injecting fuel into the engine.

In yet another aspect of the disclosure, a method operating an engine includes determining a first pulse width duration for a fuel injector based on engine speed and throttle position, determining a barometric pressure, when the first pulse width duration is less than a minimum duration, determining a second pulse width duration as a function of barometric pressure, and operating the fuel injector with the second pulse width duration.

In yet another aspect of the disclosure, a system for operating an engine includes a fuel injector, an engine speed sensor, a barometric pressure sensor generating a barometric pressure signal corresponding to a barometric sensor and a controller coupled to the fuel injector, engine speed sensor, the barometric pressure sensor and the fuel injector. The controller determines a first pulse width duration for operating the fuel injector based on engine speed and throttle position, said controller determining a second pulse width duration as a function of barometric pressure when the first pulse width duration is less than a minimum duration, and communicating a pulse having a second pulse width duration. The fuel injector operates with the second pulse width duration.

In yet another aspect of the disclosure, a method of operating an engine comprises determining a first pulse width duration for a fuel injector based on engine speed and throttle position, determining at least one of a fuel pressure and a fuel temperature, and determining a pulse width correction factor as a function of at least one of a fuel pressure and a fuel temperature. The method further comprises determining a second pulse duration based on the pulse width correction factor and operating the fuel injector with the second pulse width duration.

In yet another aspect of the disclosure, a system of operating an engine comprises a fuel injector, an engine speed sensor generating an engine speed signal corresponding to an engine speed, a throttle position sensor generating a throttle position signal corresponding to a throttle position, a sensor module comprising at least one of a fuel pressure sensor generating a fuel pressure signal corresponding to a fuel pressure into the engine and a fuel temperature sensor generating a fuel temperature signal corresponding to a fuel temperature into the engine. A controller is coupled to the fuel injector, the engine speed sensor and the sensor module. The controller determines a pulse width duration for the fuel injector based on engine speed and throttle position, determining a pulse width correction factor as a function of at least one of the fuel temperature signal and the fuel pressure signal, determining a second pulse width duration based on the first pulse width, and operating the fuel injector with the second pulse width duration.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 6A is table of first pulse timing for fuel pressure versus water temperature of the engine.

Corresponding reference numerals indicate corresponding parts throughout the several views of the drawings.

DETAILED DESCRIPTION

Example embodiments will now be described more fully with reference to the accompanying drawings. Although the following description includes several examples of a snowmobile application, it is understood that the features herein may be applied to any appropriate vehicle, such as motorcycles, all-terrain vehicles, utility vehicles, moped, scooters, etc. The examples disclosed below are not intended to be exhaustive or to limit the disclosure to the precise forms disclosed in the following detailed description. Rather, the examples are chosen and described so that others skilled in the art may utilize their teachings.

Figure 1:
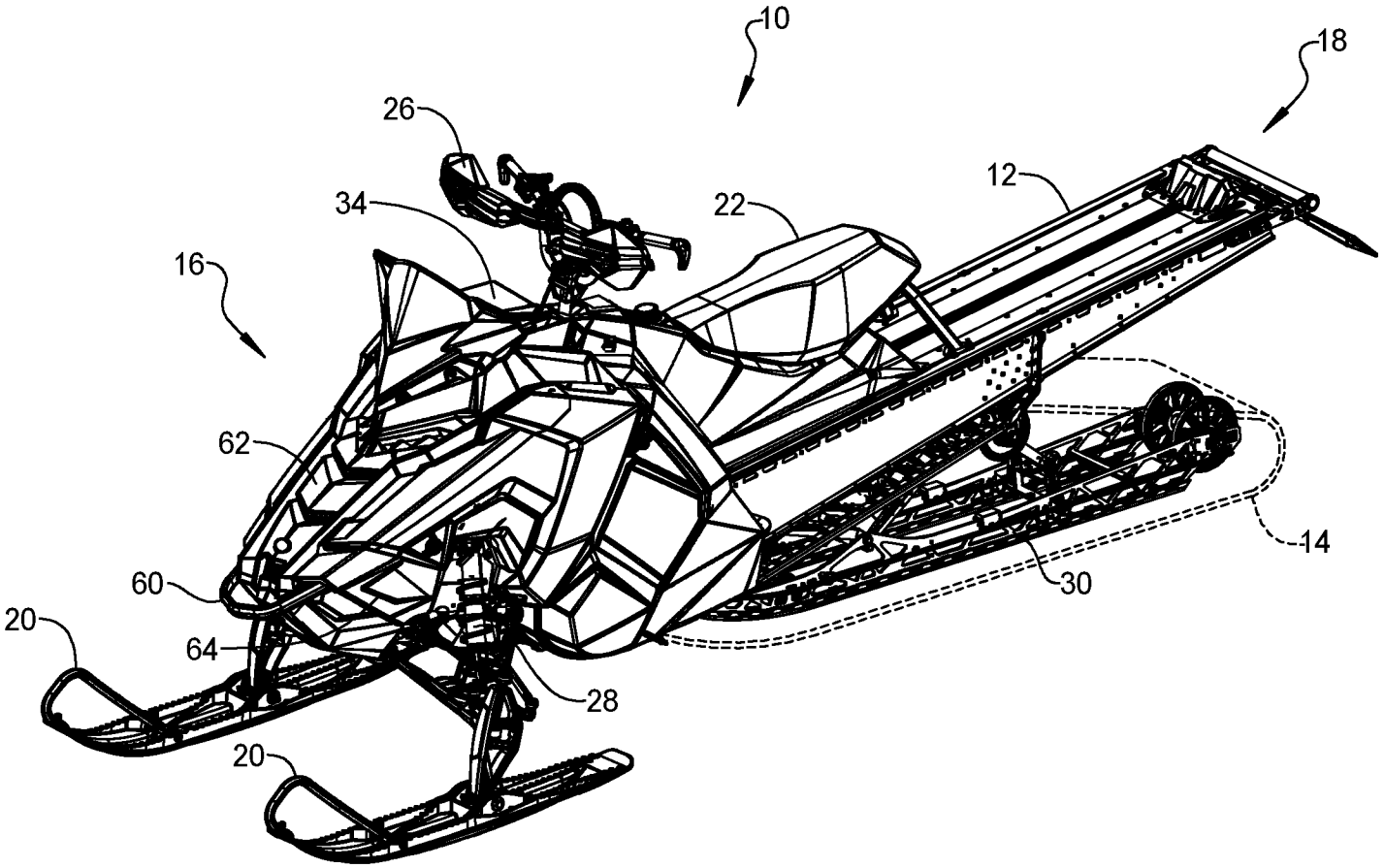
FIG. 1 is a perspective view of an exemplary a snowmobile.
Figure 2:
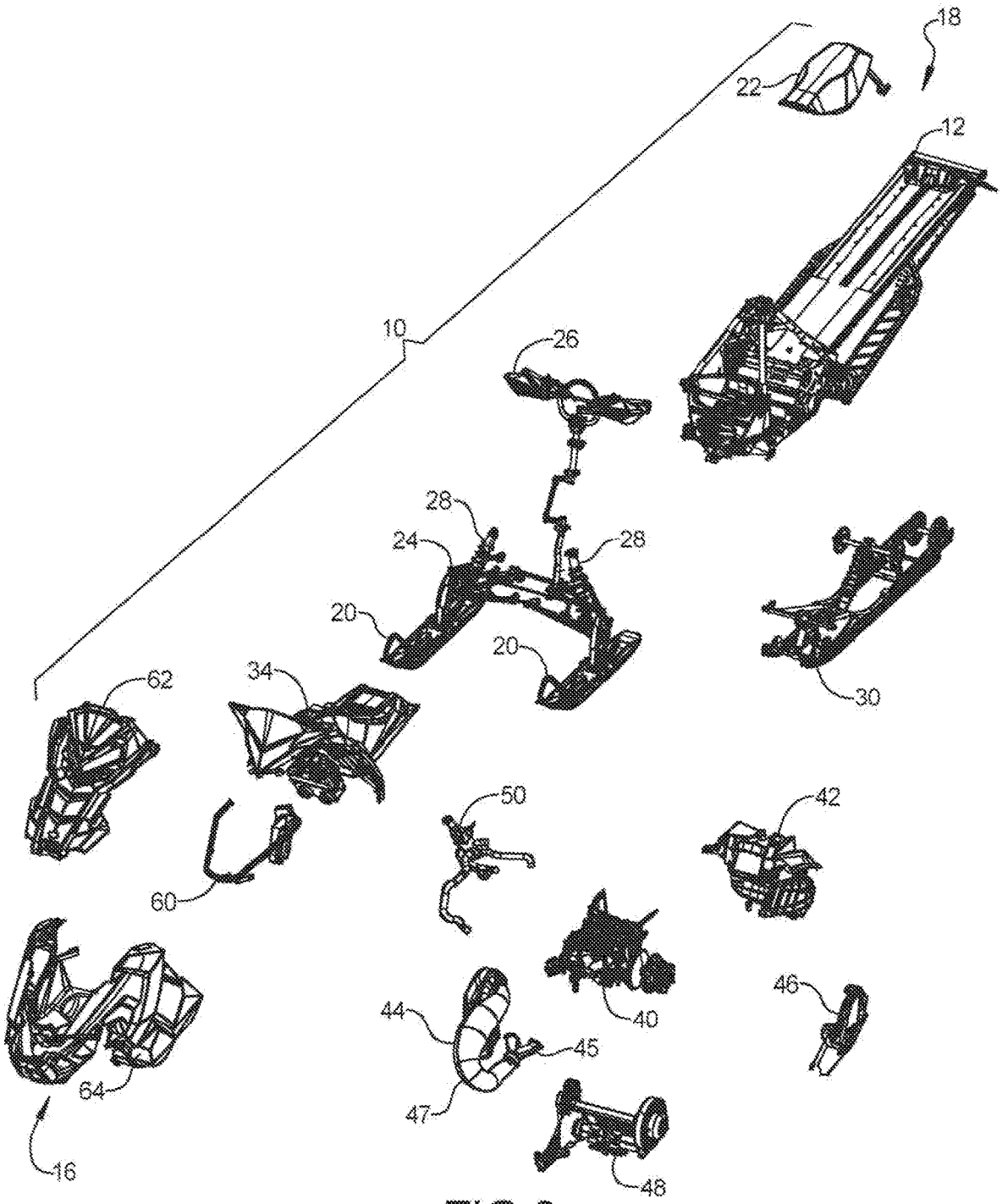
FIG. 2 is an exploded view of the snowmobile of FIG. 1.

Referring now to FIGS. 1 and 2, one embodiment of an exemplary snowmobile 10 is shown. Snowmobile 10 includes a chassis 12, an endless belt assembly 14, and a pair of front skis 20. Snowmobile 10 also includes a front-end 16 and a rear-end 18.

The snowmobile 10 also includes a seat assembly 22 that is coupled to the chassis assembly 12. A front suspension assembly 24 is also coupled to the chassis assembly 12. The front suspension assembly 24 may include handlebars 26 for steering, shock absorbers 28 and the skis 20. A rear suspension assembly 30 is also coupled to the chassis assembly 12. The rear suspension assembly 30 may be used to support the endless belt 14 for propelling the vehicle. An electrical console assembly 34 is also coupled to the chassis assembly 12. The electrical console assembly 34 may include various components for displaying engine/structure (i.e., gauges) and for electrically controlling the snowmobile 10.

The snowmobile 10 also includes an engine assembly 40. The engine assembly 40 is coupled to an intake assembly 42 and an exhaust assembly 44. The intake assembly 42 is used for providing fuel and air into the engine assembly 40 for the combustion process. Exhaust gas leaves the engine assembly 40 through the exhaust assembly 44. An oil tank assembly 46 is used for providing oil to the engine for lubrication and for mixing with the fuel in the intake assembly 42. A drivetrain assembly 48 is used for converting the rotating crankshaft assembly from the engine assembly 40 into a potential force to use the endless belt 14 and thus the snowmobile 10. The engine assembly 40 is also coupled to a cooling assembly 50.

The chassis assembly 12 may also include a bumper assembly 60, a hood assembly 62 and a nose pan assembly 64. The hood assembly 62 is movable to allow access to the engine assembly 40 and its associated components.

Figure 3A:
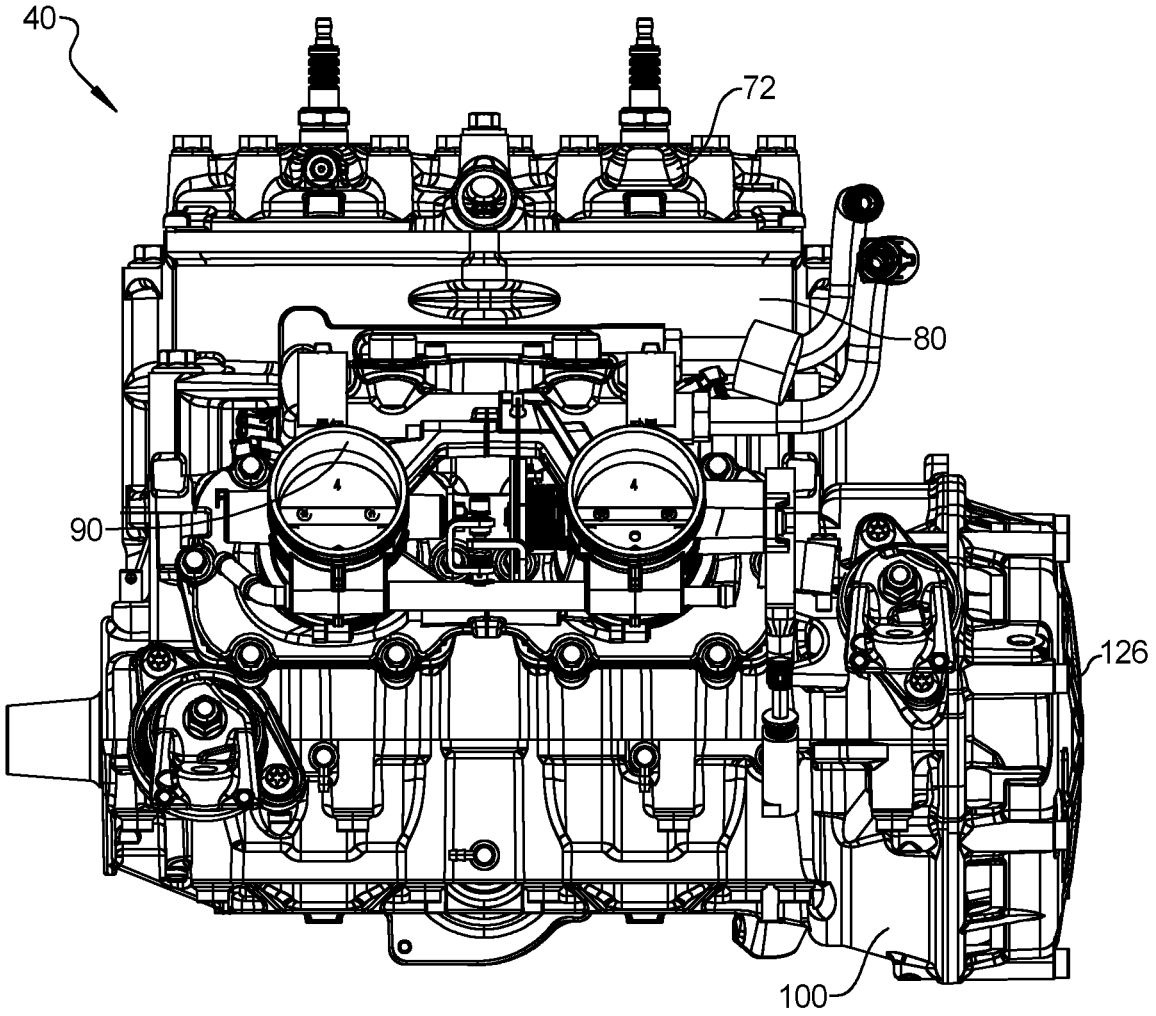
FIGS. 3A and 3B are opposite side views of the engine of FIG. 2.
Figure 3B:
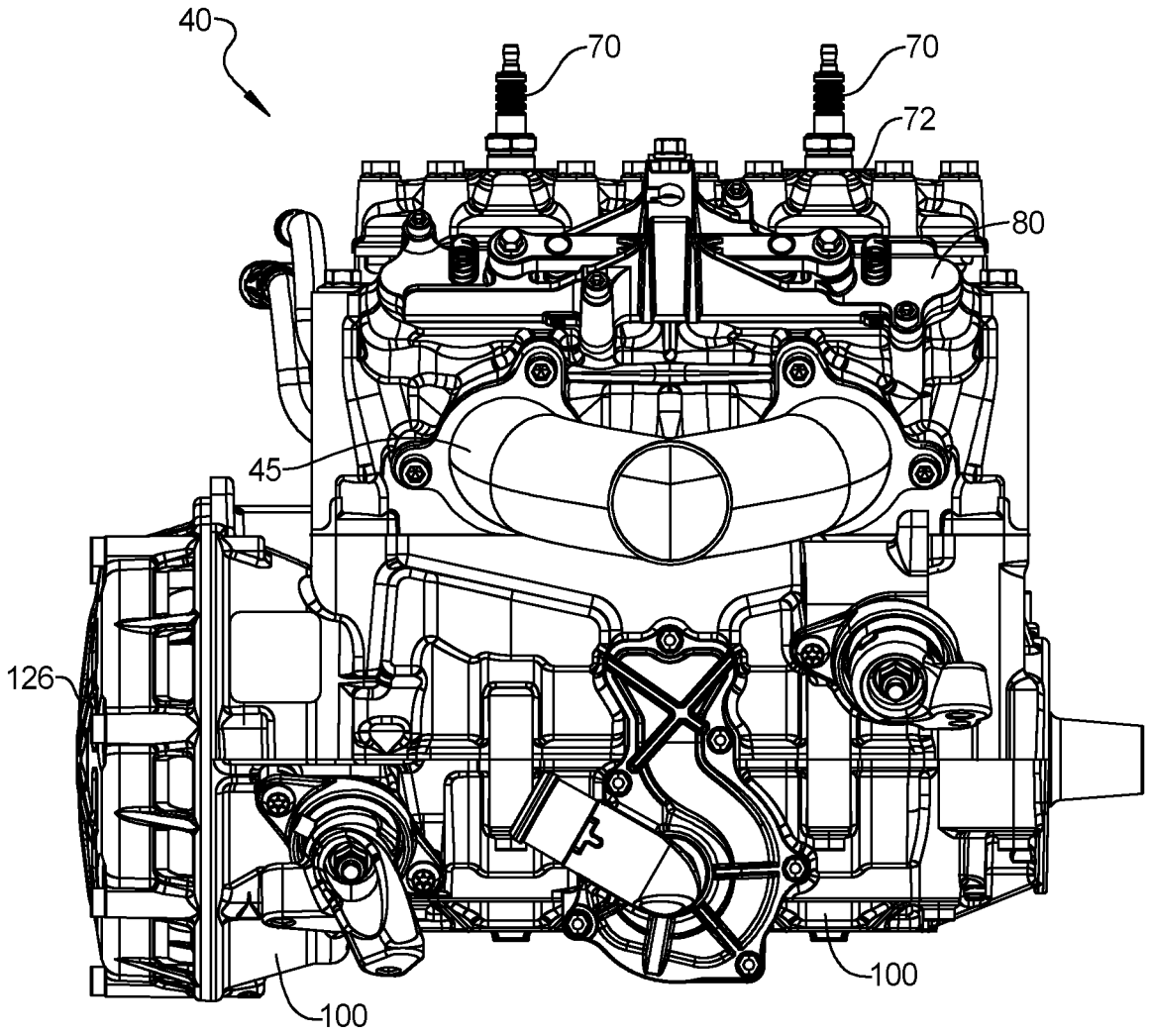
Figure 4:
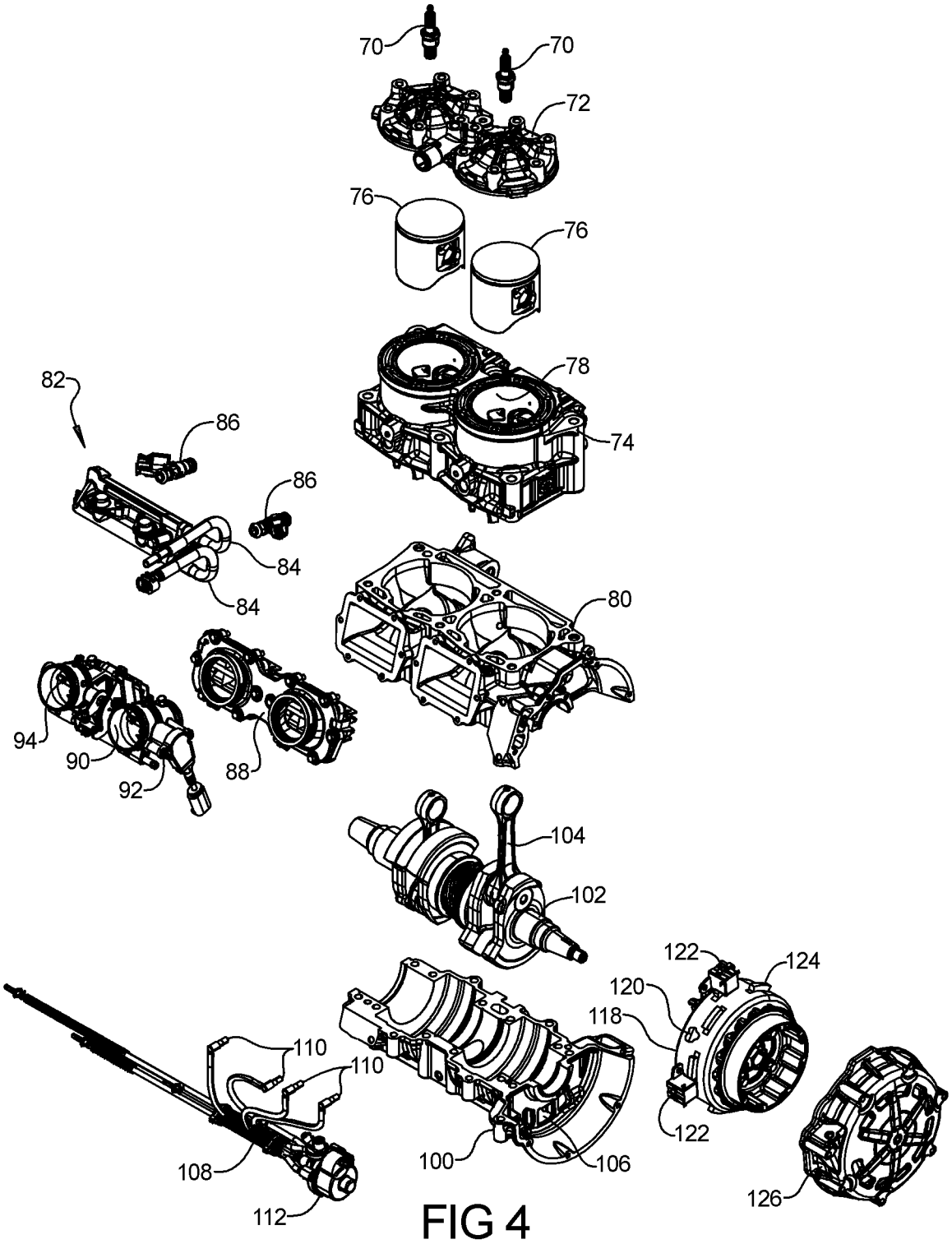
FIG. 4 is an exploded view of the engine of FIG. 3.

Referring now to FIGS. 3A, 3B and 4, the engine assembly 40 is illustrated in further detail. The engine assembly 40 is a two-stroke engine that includes the exhaust assembly 44 that includes an exhaust manifold 45 and an exhaust pipe 47.

The engine assembly 40 may include spark plugs 70 which are coupled to a one-piece cylinder head cover 72. The cylinder head cover 72 is coupled to the cylinder head 74 with six bolts which is used for housing the single-ring pistons 76 to form a combustion chamber 78 therein. The cylinder head 74 is mounted to the engine block 80.

The fuel system 82 that forms part of the intake assembly 42, includes fuel lines 84 and fuel injectors 86. The fuel lines 84 provide fuel to the fuel injectors 86 which inject fuel, in this case, into a port adjacent to the pistons 76. An intake manifold 88 is coupled to the engine block 80. The intake manifold 88 is in fluidic communication with the throttle body 90. Air for the combustion processes is admitted into the engine through the throttle body 90 which may be controlled directly through the use of an accelerator pedal or hand operated switch. A throttle position sensor 92 is coupled to the throttle to provide a throttle position signal corresponding to the position of a throttle valve of throttle plate 94 to an engine controller.

The engine block 80 is coupled to crankcase 100 and forms a cavity for housing the crankshaft 102. The crankshaft 102 has connecting rods 104 which are ultimately coupled to the pistons 76. The movement of the pistons 76 within the engine chamber 78 causes a rotational movement at the crankshaft 102 by way of the connecting rods 104. The crankcase may have openings or vents 106 therethrough.

The system is lubricated using oil lines 108 which are coupled to the oil injectors 110 and an oil pump 112.

The crankshaft 102 is coupled to a generator flywheel 118 and having a stator 120 therein. The flywheel 118 has crankshaft position sensors 122 that aid in determining the positioning of the crankshaft 102. The crankshaft position sensors 122 are aligned with the teeth 124 and are used when starting the engine as well as being used to time the operation of the injection of fuel during the combustion process. A stator cover 126 covers the stator 120 and flywheel 118.

Figure 5:
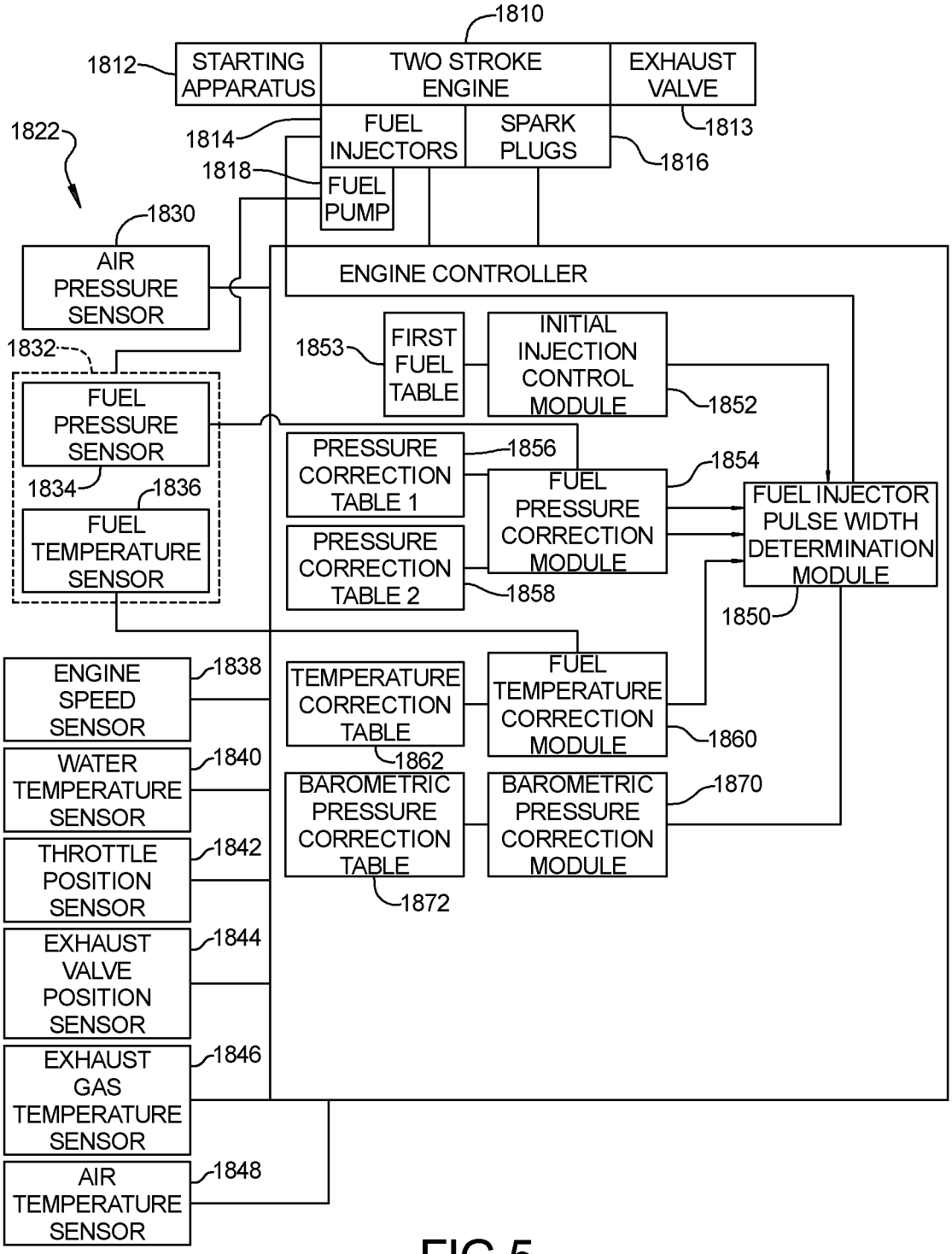
FIG. 5 is a block diagrammatic view of the engine controller relative to a plurality of sensors in the engine.

Referring now to FIG. 5, a simplified view of an engine 1810 is illustrated. The engine 1810 may be a two-stroke engine. However, teachings set forth herein may also apply to a four-stroke engine. The engine 1810 may be applied to various types of vehicles including but not limited to side-by-side vehicles, motorcycles and snowmobiles. The following disclosure is particularly suitable for snowmobiles.

The two-stroke engine 1810 is shown in a simplified view with a starting apparatus 1812 coupled thereto. The starting apparatus 1812 may include a battery starter, a pull starter or a stator for starting.

An exhaust valve 1813 or guillotine is used to control the size of the exhaust port. The position of the valve is controllable by way of an engine controller 1820.

The two-stroke engine 1810 may also include fuel injectors 1814, such as the fuel injectors 86 illustrated above. The fuel injectors 1814 operate to provide a pulse of fuel to the cylinders of the engine. The fuel injectors 1814 operate using an electrical pulse that has a pulse width that lasts for a duration of time. The duration corresponds directly to the amount of fuel injected to the engine. The air fuel mixture is drawn into a cylinder. Spark plugs 1816, such as the spark plugs 70 illustrated above, are used to ignite the air fuel mixture within the cylinder.

The engine control unit or controller 1820 is coupled to various sensors 1822 for controlling the combustion functions of the engine 1810 by controlling the fuel injectors 1814 and the spark plugs 1816. A fuel pump 1818, such as the fuel pump 112 illustrated above, is used to pressurize a fuel line 1819 and communicate fuel from the gas tank to the engine.

The sensors 1822 coupled to the engine controller 1820 provide various signals that are used for controlling the combustion processes in the engine 1810. The sensors 1822 include an air pressure sensor 1830 which generates an air pressure signal corresponding to the barometric pressure to the engine controller 1820.

A housing 1832 may include both a fuel pressure sensor 1834 and a fuel temperature sensor 1836. The fuel pressure sensor 1834 generates a fuel pressure signal corresponding to the pressure in the fuel line 1819. The fuel temperature sensor 1836 generates a signal corresponding to the fuel temperature within the fuel line 1819. The housing 1832, and thus both sensors, may be coupled to the fuel line 1819 leading to the engine 1810.

An engine speed sensor 1838 is also coupled to the controller 1820. The engine speed sensor 1838 generates a signal corresponding to the rotational speed of the engine. The rotational speed may correspond to the rotation of the crankshaft which may be in rotations per minute.

A water temperature sensor 1840 may also be in communication with the engine controller 1820. The water temperature sensor 1840 generates a signal corresponding to the coolant within the vehicle. Although the water temperature sensor 1840 is set forth as a "water" sensor, coolant such as ethylene glycol and other compounds may be used in place of or combined with water.

A throttle position sensor 1842, such as the throttle position sensor 92 illustrated above, is also in communication with the engine controller 1820. The throttle position sensor 1842 generates a signal corresponding to the throttle position. Typically, throttle position sensors are resistive in nature and provide an output voltage that corresponds to the throttle position as controlled by the vehicle operator. The throttle position sensor 1842 may correspond to the output of a floor-mounted pedal or a handle-mounted switch.

An exhaust valve position sensor 1844 may also be coupled to the engine controller 1820. The exhaust valve position sensor 1844 provides an output of the exhaust valve "guillotine" position to the engine controller. The exhaust port open timing is controlled by the controller 1820.

An exhaust gas temperature sensor 1846 provides a signal corresponding to the temperature of the exhaust gas.

An air temperature sensor 1848 generates a signal corresponding to the air temperature of air entering the engine.

The engine controller 1820 may have various modules used for adjusting the pulse width duration of the signal for controlling the fuel injectors. The electrical pulse width of the injectors corresponds to the amount of fuel injected into the engine with each pulse. As will be described in more detail below, a fuel injector pulse width determination module 1850 is used for determining the ultimate fuel injector pulse width used for each of the electrical pulses for the engine. The electrical pulses may vary based upon the various sensors input signals to the engine controller 1820. The fuel injector pulse width determination module 1850 receives a plurality of correction factors by way of signals to determine the ultimate pulse width duration applied to the fuel injectors 1814.

The fuel injection pulse width determination module 1850 receives signals from the initial injection control module 1852. The initial injection control module 1852 is used to control the initial or first injection of fuel into the system. This is particularly important for use in a batteryless vehicle. The first injection of fuel is important. But, because certain vehicles do not have a battery, the first pull of the vehicle takes some time to raise the chassis voltage and turn the fuel pump on. As will be further described below, the initial injection control module 1852 may monitor the fuel pressure and delay the initial injection of fuel until the fuel pressure raises above a fuel pressure threshold. By preventing the fuel injector from receiving electrical power when not enough fuel pressure is available, the system prevents the fuel injector from using electrical power for starting the engine. Thus, the initial injection control module 1852 commands the fuel injector pulse width determination module 1850 to delay the operation of the fuel injector.

The fuel pressure correction module 1854 generates a fuel pressure correction factor for use in the fuel injection pulse width determination module 1850. As will be further described below, the first injection of fuel is controlled by the initial fuel injection control module 1852. Thereafter, the pulse width duration of the injector is corrected based upon the fuel pressure, the fuel temperature and the barometric pressure. Each of these processes will be described in the modules below. The initial injection control module 1852 is in communication with a first fuel table 1853 that provides a first fuel value based upon water temperature and fuel pressure. That is, the initial pulse width is determined from a two-dimensional table with an axis of fuel pressure and a second axis of engine water temperature. Thus, the first pulse width is a function of the fuel pressure and the engine water temperature. An example two-dimensional table is illustrated in FIG. 6A. The X values would be replaced with actual values using experimentation in the field or on a dynamometer.

The fuel pressure correction module 1854 uses a first pressure correction table 1856 and a second pressure correction table 1858 to perform corrections based upon the fuel pressure signal from the fuel pressure sensor 1834. By controlling the duration of the pulse width based upon the fuel pressure, the fuel temperature and the barometric pressure, the system provides compensation to maintain stability margins at the edges of the operating range. As the vehicle operates in various altitudes, the stability at high elevations is maintained. Although two pressure correction tables 1856 and 1858 are illustrated, only one table may be provided. The table 1856 is a one-dimensional table that is used to replicate the pressure square root ratio correlation. The pulse width correction $PW_{corr}$ is:

$$PW_{Corr} = PW_{Base} * \sqrt{\frac{P}{P_{ref}}} * \frac{\mathrm{Trim}_{(N,P)}}{100}$$

wherein the $PW_{Base}$ is the base pulse width calculated from the engine rpms and throttle position, P is the measure fuel pressure, $P_{ref}$ is the reference pressure and Trim is a desired amount of offset as a function of Pressure, P and the engine speed, N. Trim may be experimentally determined based on various operating engine speeds and pressures.

The second pressure correction table 1858 may take the form of a two-dimensional table having an access of the speed of the engine and fuel pressure. That is, a second pressure correction may have the ordinates of engine speed and the fuel pressure. The fuel pressure correction module provides a first correction from the pressure correction table 1 and the second pressure correction table 1858 to the fuel injector pulse width determination module 1850. Fuel injector voltage may also be an ordinate.

A fuel temperature correction module 1860 receives a fuel temperature sensor signal from the fuel temperature sensor. The fuel temperature sensor signal provides a temperature corresponding to the fuel temperature within a fuel line of the vehicle. A temperature correction table 1862 provides a two-dimensional table for determining a temperature correction. The temperature correction table has an axis of engine speed in rpms and the fuel temperature as a second axis. Again, the temperature correction table may provide a temperature correction factor that is used by the fuel injection pulse width determination module 1850.

Figure 6B:
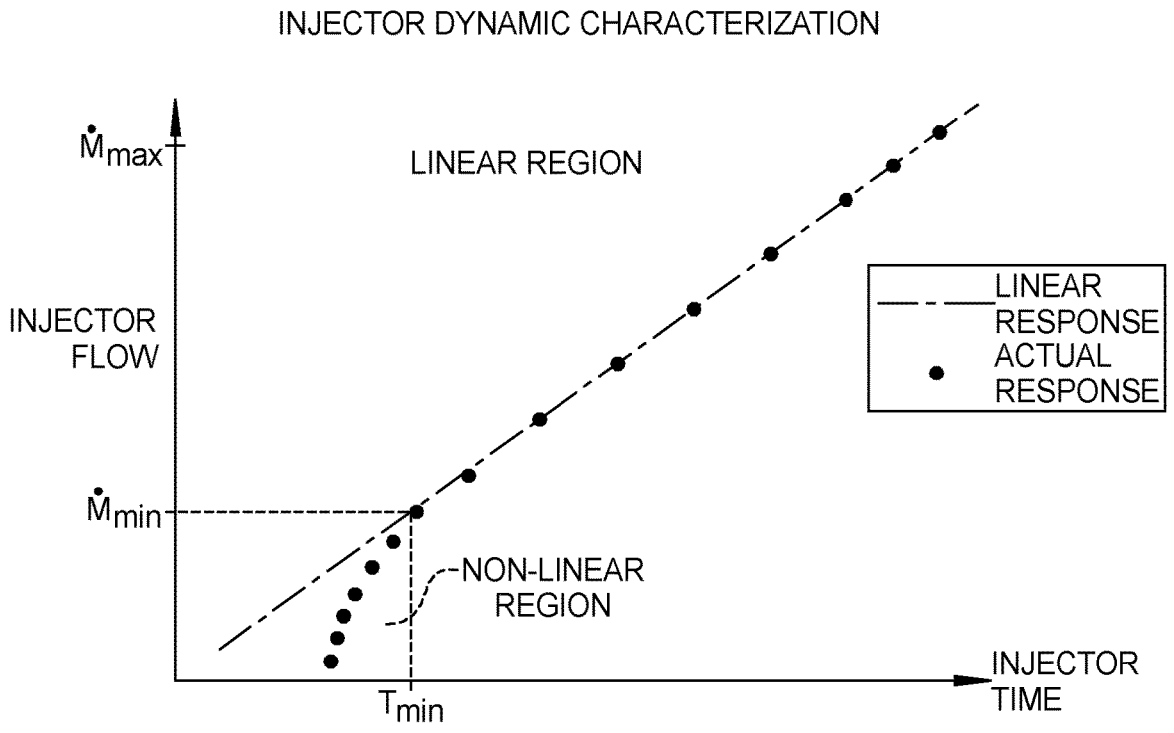
FIG. 6B is a plot of injector flow characteristics.

A barometric pressure correction module 1870 is used for determining a barometric pressure correction. The barometric pressure correction module 1870 is used for setting a minimum floor for the pulse width duration. When the pulse width duration is below a predetermined pulse width duration, the barometric pressure correction table or authority table 1872 is used for determining a new injection pulse width duration in the place of the minimum. Previously, the minimum calculated pulse width duration was the cutoff. However, it has been found that if the final corrected duration is less than the minimum duration characteristic of the injectors, the engine controller may calculate a commanded duration which overrules the calculation and uses a calibratable minimum injection in its place. As illustrated in FIG. 6B, the injector flow has a linear region and a non-linear region. The linear region corresponds to an injection time below $T_{min}$. In this area, the barometric pressure correction table 1872 may be calibrated based upon the barometric pressure to reduce the injector time below the previously calculated minimum.

Figure 6C:
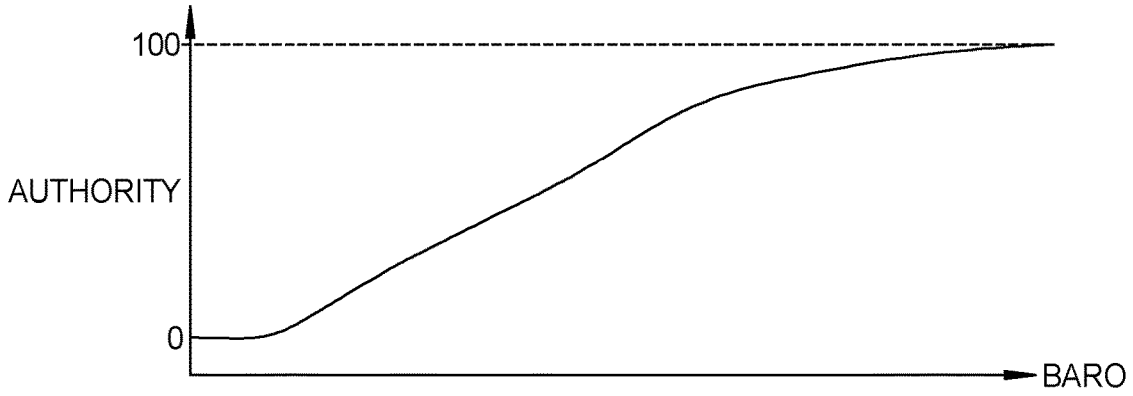
FIG. 6C is a plot of the correction authority determined in response to barometric pressure.

Referring now to FIG. 6C, one example of the barometric pressure correction table 1872 is set forth. An authority is shown plotted against the barometric pressure. As the barometric pressure rises, the amount of the correction factor or authority value increases. The final pulse width $T_{final}$ is equal to $T_c+A_{min}(T_{min}-T_c)$.

$T_c$ is the previously determined minimum correction factor. The determination of this will be described in further detail below.

Figure 7A:
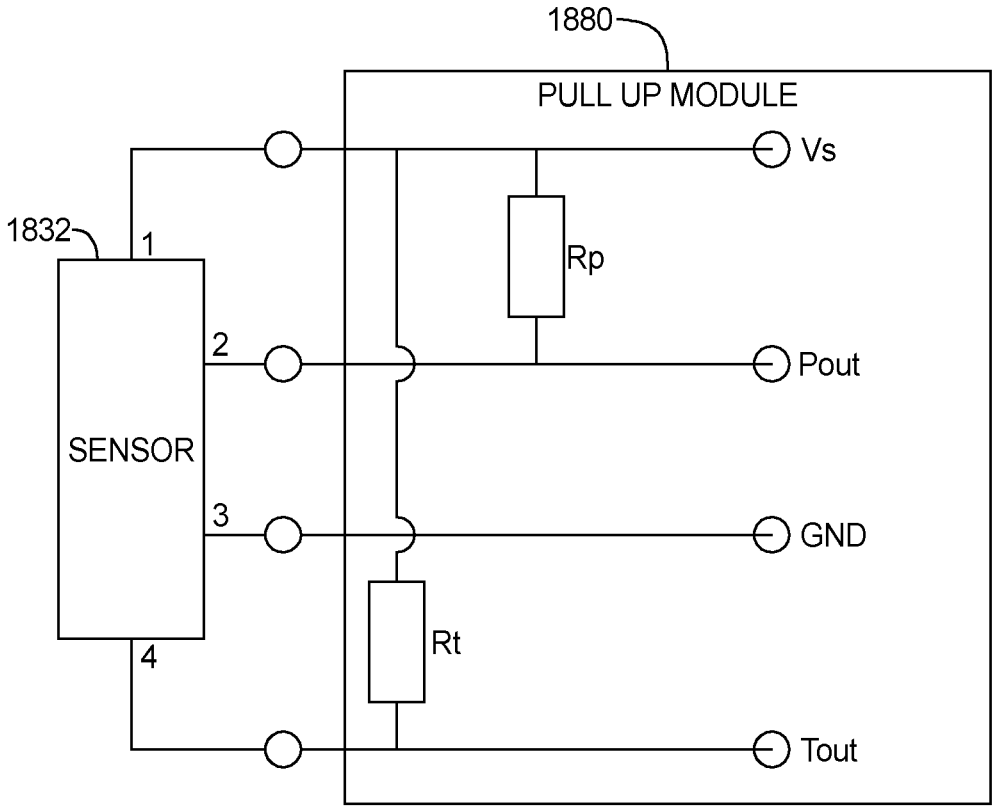
FIG. 7A is a schematic view of the temperature and pressure sensor.
Figure 7B:
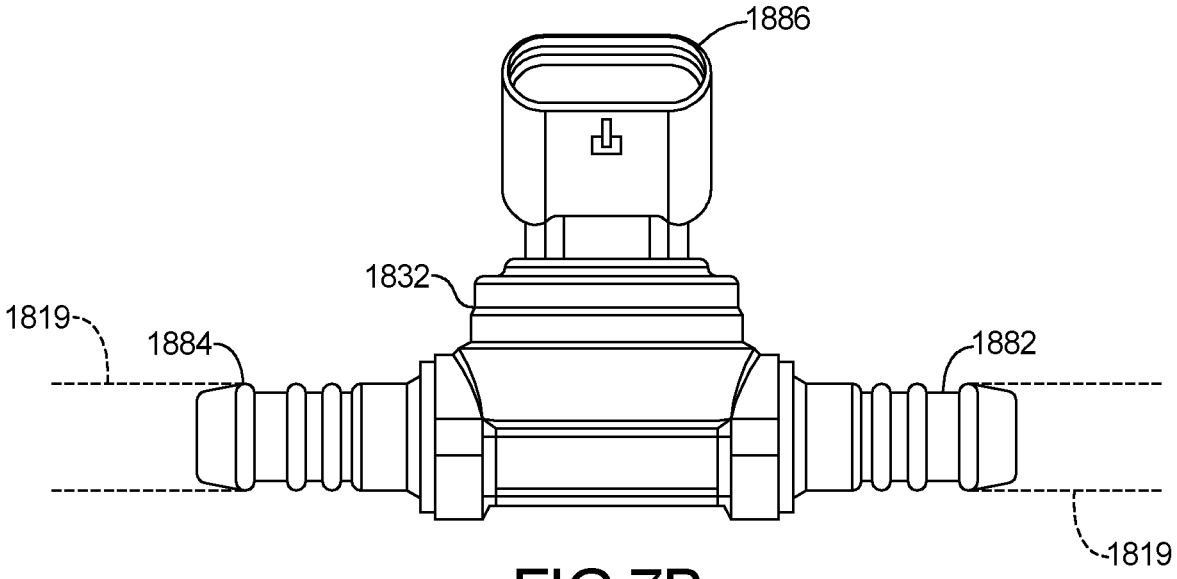
FIG. 7B is a side view of the temperature and pressure sensor shown with adjacent fuel line input and output.

Referring now to FIGS. 7A and 7B, the sensor housing 1832 is illustrated in further detail. That is, the sensor housing 1832 has both the fuel pressure sensor 1834 and the fuel temperature pressure 1836 illustrated in FIG. 5. A pull-up module 1880 may be disposed as a discrete component or as a component within the engine controller 1820. The pull-up module 1880 includes a pressure pull-up resistor Rp which is coupled between the supply voltage $V_s$ and the pressure voltage output signal $P_{out}$. A temperature pull-up resistor $R_t$ is coupled between the supply voltage $V_s$ and the temperature voltage signal $T_{out}$. A ground signal (GND) is also output from the pull-up module.

In FIG. 7B, the fuel line 1819 has an input 1882 and an output 1884 that passes fuel through the housing 1832. A connector 1886 is used for connecting the sensor to the engine control module.

Figure 8:
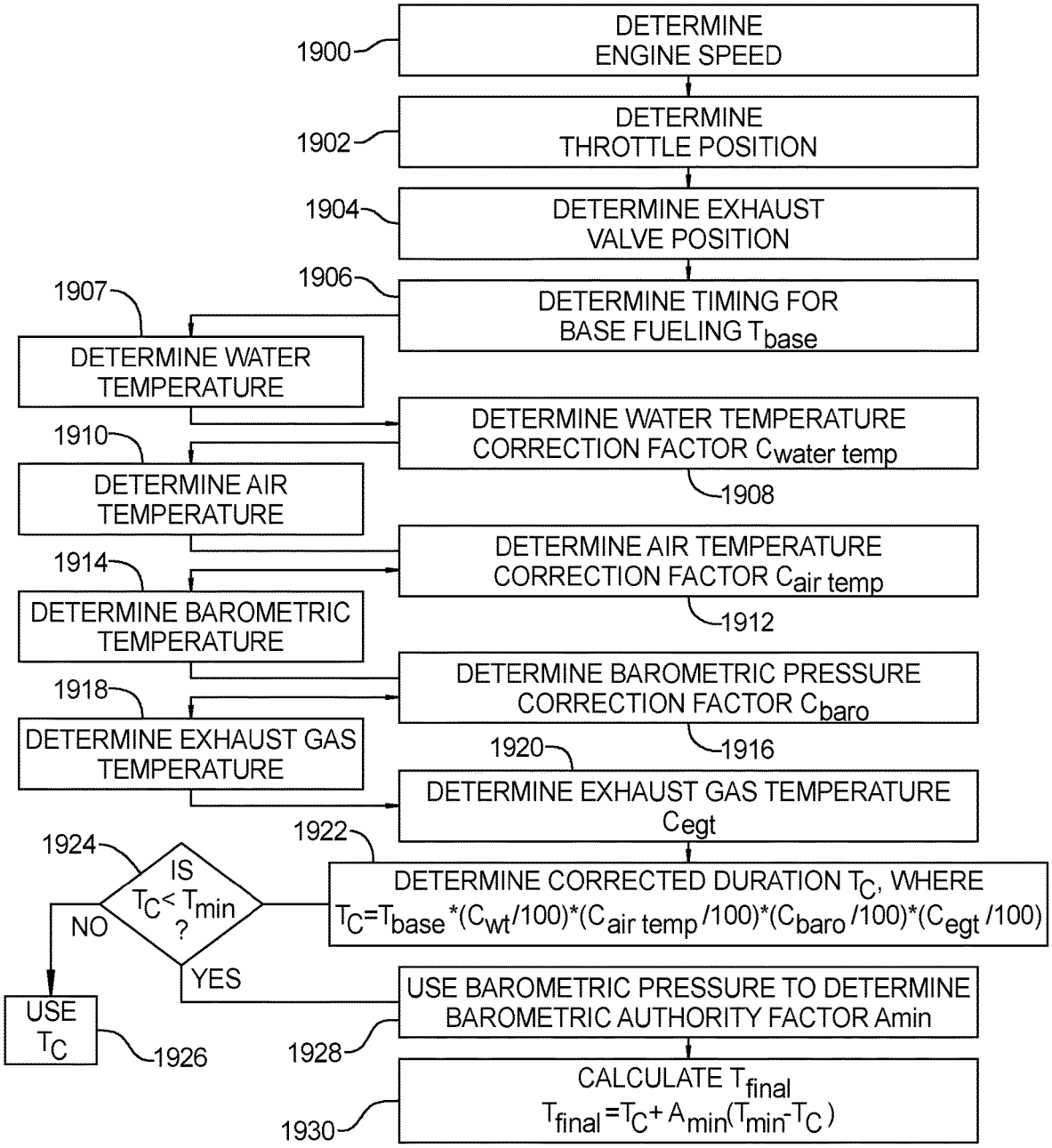
FIG. 8 is a flowchart of a method for correcting a minimum pulse width duration using barometric pressure.

Referring now to FIG. 8, a method for operating an engine and determining pulse width is set forth. In step 1900, the engine speed is determined. The engine speed may be determined in rotations per minute from the engine speed sensor 1838 illustrated above. In step 1902, the throttle position is determined using the throttle position sensor 1842 illustrated in FIG. 5. In step 1904, an exhaust valve position is determined. In step 1906, a timing for base fueling $T_{base}$ is determined using the engine speed, the throttle position sensor position and a valve position. In step 1907, a water temperature is determined for the coolant within the engine. This may be performed using the water temperature sensor 1840 illustrated in FIG. 5. In step 1908, a water temperature correction factor $C_{wt}$ is determined. The water temperature correction factor $C_{wt}$ is determined as a function of the water temperature and the speed of the engine. In step 1910, the air temperature of the intake air to the vehicle is determined by the air temperature sensor 1848 illustrated in FIG. 5. The air temperature is the intake air temperature to the engine. In step 1912, an air temperature correction factor $C_{airtemp}$ is determined. The air temperature correction factor is based on the engine speed and the air temperature. In step 1914, the barometric pressure around the vehicle is determined using the air pressure sensor 1830 illustrated in FIG. 5. In step 1916, the barometric pressure correction factor $C_{baro}$ is determined as a function of the barometric pressure and the engine speed. Each of the correction factors may be experimentally determined.

In step 1922, a corrected duration $T_c$ is determined where the base is multiplied by the correction factor of the water temperature, the air temperature correction factor, the barometric pressure correction factor and the exhaust gas temperature correction factor. In step 1924, it is determined whether the corrected duration $T_c$ is less than a minimum pulse width duration. If the correction duration is not less than the minimum, pulse width is set at $T_c$ in step 1926.

In step 1928, the barometric pressure determined in step 1914 is used to determine a barometric pressure authority factor $A_{min}$. This is performed using the barometric pressure correction table 1872 of FIG. 5. In step 1930, a final pulse width duration $T_{final}$ is determined using the formula described above in the barometric pressure correction module 1870.

It should be noted that FIG. 8 takes place during normal operation of the engine. FIG. 8 uses the barometric pressure to change the minimum duration of the pulse width.

Figure 9:
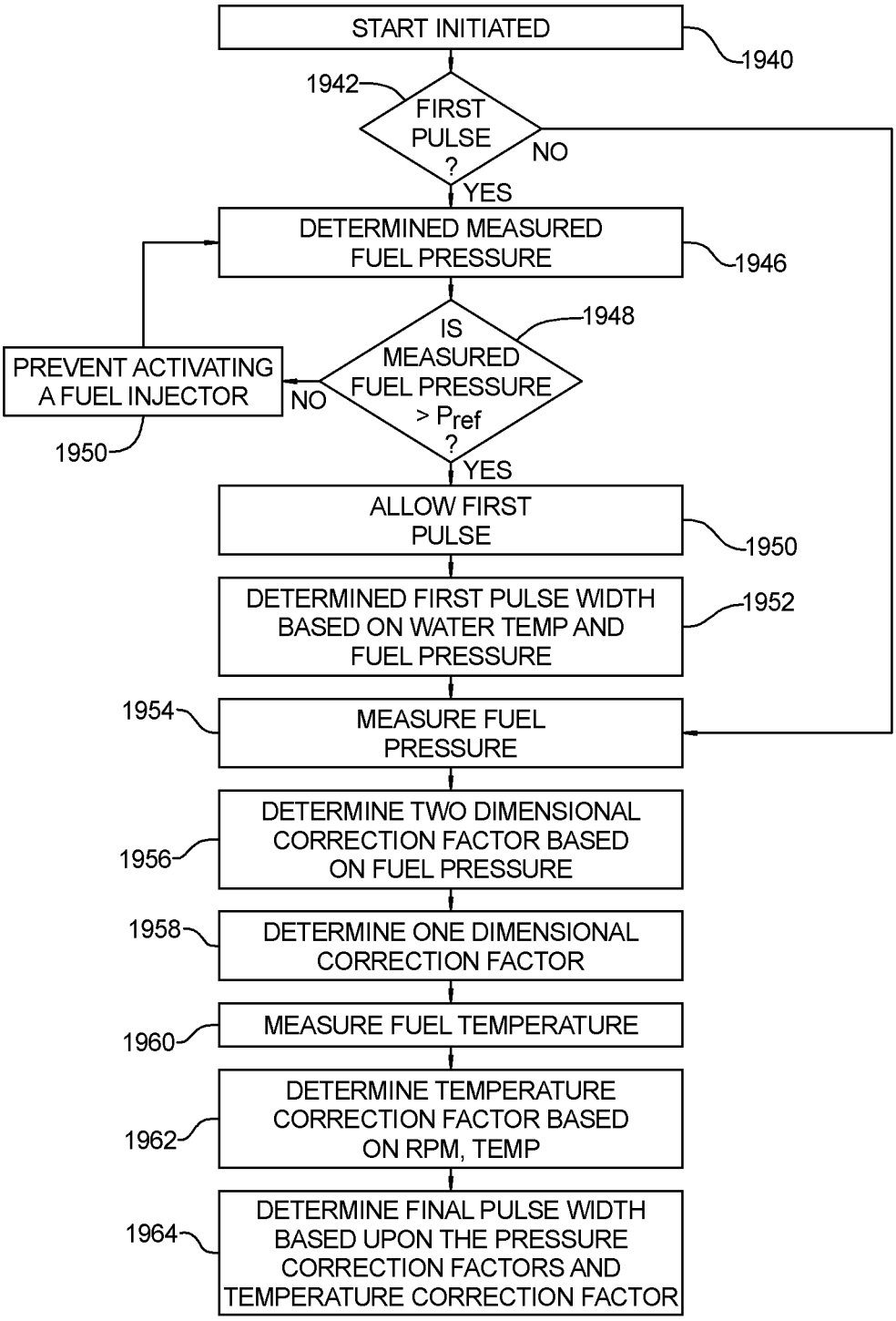
FIG. 9 is a flowchart of a method for starting the engine using a first pulse and then correcting for fuel pressure and fuel temperature.

Referring now to FIG. 9, the steps set forth take place during the initial starting of the engine and to correct for fuel and temperature pressure. In step 1940, starting is initiated. As mentioned above, starting may be initiated using a battery or pull starting the engine. In step 1942, it is determined whether the system is injecting the first pulse upon start-up. As the system becomes energized, the engine controller, the fuel pump and the injectors are becoming energized. The energization of the fuel injectors may be suppressed before the first pulse. This prevents the fuel injectors from using electrical power. In step 1946, the fuel pressure is determined using the fuel pressure sensor 1834. In step 1948, it is determined whether the measured fuel pressure is greater than a reference pressure. If the measured pressure from step 1946 is not greater than the reference pressure. The fuel injector is prevented from activating in step 1950. After step 1950, step 1946 is performed.

In step 1948, when the measured pressure is greater than the reference pressure, the first pulse is allowed in step 1950. In step 1952, the first pulse width is determined based upon the water temperature and the fuel pressure from the first fuel table 1853 illustrated in FIG. 5. In step 1954, the fuel pressure is measured. Step 1954 is also performed after the pulse is not the first pulse in step 1942. That is, after step 1942, the engine is started and the initial steps 1946-1952 do not need to be performed.

In step 1956, a two-dimensional correction factor based on the fuel pressure is determined based on the fuel pressure. This is obtained from the pressure correction table 1856. In step 1958, a one-dimensional pressure correction actor is also obtained from the pressure correction table 1858. In step 1960, the fuel temperature is measured. In step 1962, the temperature correction factor is determined from the temperature correction table 1862. In step 1964, the final pulse width is determined based upon the temperature correction factor and the pressure correction factor as determined above.

Among the advantages of delaying the start pulse is the better perception of quality of the engine starting process by the consumer. Better control is had by monitoring the furl temperature and pressure. The pistons run cooler and thus the life of the engine is increased.

Examples are provided so that this disclosure will be thorough, and will fully convey the scope to those who are skilled in the art. Numerous specific details are set forth such as examples of specific components, devices, and methods, to provide a thorough understanding of examples of the present disclosure. It will be apparent to those skilled in the art that specific details need not be employed, that examples may be embodied in many different forms and that neither should be construed to limit the scope of the disclosure. In some examples, well-known processes, well-known device structures, and well-known technologies are not described in detail.

The foregoing description has been provided for purposes of illustration and description. It is not intended to be exhaustive or to limit the disclosure. Individual elements or features of a particular example are generally not limited to that particular example, but, where applicable, are interchangeable and can be used in a selected example, even if not specifically shown or described. The same may also be varied in many ways. Such variations are not to be regarded as a departure from the disclosure, and all such modifications are intended to be included within the scope of the disclosure.

What is claimed is:

1. A method comprising:

initiating starting of a two stroke engine;

determining fuel pressure from a pressure sensor in a fuel line of the two stroke engine;

when the fuel pressure is below a fuel pressure threshold, preventing a fuel injector from injecting fuel into the engine; and when the fuel pressure is above the fuel pressure threshold, injecting fuel into the engine by powering the fuel injector using a pulse width duration determined in response to the fuel pressure and a barometric pressure for each electrical pulse.

2. The method of claim 1 wherein initiating comprises initiating starting with a starting apparatus.

3. The method of claim 1 wherein determining fuel pressure comprises determining fuel pressure in a fuel line to a fuel injector.

4. The method of claim 1 wherein preventing the fuel injector from injecting comprises preventing power to the fuel injector.

5. The method of claim 1 further comprising determining the pulse width duration based on an exhaust gas temperature.

6. The method of claim 1 further comprising determining the pulse width duration based on water temperature.

7. The method of claim 1 further comprising determining the pulse width duration based on water temperature from a two dimensional table.

8. The method of claim 1 further comprising determining the pulse width duration in response to air temperature.

9. The method of claim 1 further comprising determining the pulse width duration based on an exhaust gas temperature.

10. The method of claim 1 further comprising determining the pulse width duration based on water temperature, air temperature and an exhaust gas temperature.

11. A method comprising:

initiating starting of an engine;

determining fuel pressure from a pressure sensor in a fuel line of the two stroke engine;

when the fuel pressure is below a fuel pressure threshold, preventing a fuel injector from injecting fuel into the engine; and when the fuel pressure is above the fuel pressure threshold, injecting fuel into the engine by powering the fuel injector using a pulse width duration determined in response to the fuel pressure and a barometric pressure for each electrical pulse.

* * * * *